US009776201B2

(12) United States Patent
Kim et al.

(10) Patent No.: US 9,776,201 B2
(45) Date of Patent: Oct. 3, 2017

(54) ULTRASONIC ATOMIZER FOR ASEPTIC PROCESS

(71) Applicant: PEPTRON, INC., Daejeon (KR)

(72) Inventors: Joon Sik Kim, Daejeon (KR); Ju Han Lee, Daejeon (KR); Dong Pil Won, Daejeon (KR); Jin Woo Lee, Daejeon (KR); Ho Il Choi, Daejeon (KR)

(73) Assignee: PEPTRON, INC., Daejeon (KR)

( * ) Notice: Subject to any disclaimer, the term of this patent is extended or adjusted under 35 U.S.C. 154(b) by 0 days.

(21) Appl. No.: 15/029,612

(22) PCT Filed: Aug. 19, 2014

(86) PCT No.: PCT/KR2014/007658
§ 371 (c)(1),
(2) Date: Apr. 14, 2016

(87) PCT Pub. No.: WO2015/056874
PCT Pub. Date: Apr. 23, 2015

(65) Prior Publication Data

US 2016/0263612 A1 Sep. 15, 2016

(30) Foreign Application Priority Data

Oct. 17, 2013 (KR) ..... 10-2013-0124096

(51) Int. Cl.
*B05B 17/06* (2006.01)
*F28F 13/10* (2006.01)

(52) U.S. Cl.
CPC ..... *B05B 17/0653* (2013.01); *B05B 17/06* (2013.01); *F28F 13/10* (2013.01)

(58) Field of Classification Search
CPC . B05B 17/06; B05B 17/0653; B05B 17/0623; F28F 13/10
(Continued)

(56) References Cited

U.S. PATENT DOCUMENTS 4,081,233 A 3/1978 Kitajima et al.
4,723,708 A * 2/1988 Berger ..... B05B 17/0623 239/102.2
(Continued)

FOREIGN PATENT DOCUMENTS

CN 201316696 Y 9/2009
CN 203124179 U 8/2013
(Continued)

OTHER PUBLICATIONS

Extended European Search Report from European Application No. 14854358.0, dated May 12, 2017.

*Primary Examiner* — Jason Boeckmann
(74) *Attorney, Agent, or Firm* — McDermott, Will & Emery LLP

(57) ABSTRACT

An ultrasonic atomizer for maintaining a constant temperature of an ultrasonic vibration generating unit by decreasing a temperature at the periphery of the ultrasonic vibration generating unit even under an environment in which the ultrasonic vibration generating unit is exposed to a high temperature is provided. The ultrasonic atomizer includes: an ultrasonic vibration generating unit which generates ultrasonic waves and atomizes a spray material; a nozzle unit; a heat exchange unit which cools heat generated from the ultrasonic vibration generating unit; and a housing which has heat exchange chambers, where the heat exchange chambers include: a vortex chamber which is positioned in the housing at the periphery of the ultrasonic vibration generating unit and guides a vortex flow; and a thermal insulation chamber which surrounds the vortex chamber and has a separation wall which abuts the vortex chamber, and includes an internal thermal insulation space.

9 Claims, 4 Drawing Sheets

(58) Field of Classification Search
USPC ..... 239/102.1, 102.2, 132, 132.1, 132.3
See application file for complete search history.

(56) References Cited

U.S. PATENT DOCUMENTS

| | | | | |
|---|---|---|---|---|
| 4,978,067 | A * | 12/1990 | Berger | B05B 17/063 239/102.2 |
| 5,163,433 | A | 11/1992 | Kagawa et al. | |
| 5,516,043 | A | 5/1996 | Manna et al. | |
| 5,560,362 | A | 10/1996 | Sliwa, Jr. et al. | |
| 5,918,593 | A | 7/1999 | Loser | |
| 5,961,465 | A | 10/1999 | Kelly, Jr. et al. | |
| 2004/0256973 | A1 | 12/2004 | Imamura | |
| 2007/0176017 | A1* | 8/2007 | Berger | B05B 17/063 239/102.2 |
| 2009/0224066 | A1* | 9/2009 | Riemer | A21C 15/002 239/102.2 |
| 2016/0030959 | A1* | 2/2016 | Moon | C23C 14/12 239/589 |
| 2016/0263611 | A1* | 9/2016 | Kim | B05B 17/06 |

FOREIGN PATENT DOCUMENTS

| | | | |
|---|---|---|---|
| DE | 2604240 | A1 | 12/1976 |
| JP | 39-005781 | | 3/1964 |
| JP | 59-230660 | | 12/1984 |
| JP | 61-220756 | | 10/1986 |
| JP | S61-259783 | A | 11/1986 |
| JP | 04-060323 | | 2/1992 |
| JP | H04-110057 | A | 4/1992 |
| JP | 05-042103 | | 2/1993 |
| JP | H05-282934 | A | 10/1993 |
| JP | 05-344952 | | 12/1993 |
| JP | 2006-064370 | A | 3/2006 |
| JP | 2010-234335 | A | 10/2010 |
| JP | 2012-035235 | A | 2/2012 |
| JP | 5099807 | B2 | 12/2012 |
| KR | 20-2012-0005780 | U | 3/2007 |
| KR | 10-2011-0090039 | A | 7/2012 |
| KR | 10-1168490 | B1 | 7/2012 |
| KR | 10-2010-0132449 | A | 8/2012 |
| KR | 10-0690282 | B1 | 8/2012 |
| KR | 10-2013-0008258 | A | 1/2013 |
| KR | 10-2013-0023664 | A | 3/2013 |
| RU | 2033279 | C1 | 4/1995 |
| RU | 2446894 | C1 | 4/2012 |
| SU | 692163 | A1 | 9/1980 |
| WO | WO-96/09121 | A1 | 3/1996 |
| WO | WO-2013/020758 | A1 | 2/2013 |

* cited by examiner

ULTRASONIC ATOMIZER FOR ASEPTIC PROCESS

BACKGROUND OF THE INVENTION (a) Field of the Invention

An apparatus for spraying a spray material using ultrasonic vibration is provided.

(b) Description of the Related Art

Pharmaceutical drugs used to treat patients need to be produced under a clean environment in order to ensure safety. In particular, an injection contaminated by microorganisms or the like may have a fatal side effect on human bodies. Thus, all processes for producing the injection needs to be carried out in an aseptic state. To maintain the aseptic state when the injection is produced, a process of sterilizing all machines, which are likely to come into contact with the products, needs to be carried out prior to other processes. Further, the aseptic state needs to be maintained to perform a process of producing the injection. As sterilization methods generally used for a process of producing pharmaceutical drugs, there are a high-temperature dry heat sterilization method and a high-pressure steam sterilization method.

A sustained-release microsphere injection is generally manufactured as a biodegradable polymer microsphere dosage form containing active materials through a process such as a spray drying method, an O/W emulsion method, a W/O/W emulsion method, or a phase separation method.

When the sustained-release microsphere injection is produced through the spray drying method, a solution, emulsion, suspension, or the like, which contains active materials and biodegradable polymers, may be sprayed in the form of fine droplets into a dryer by means of an ultrasonic atomizer.

The ultrasonic atomizer is an apparatus that converts electrical energy into vibrational energy and provides a spray material with ultrasonic vibration having an output frequency, thereby spraying the spray material. In a case in which the spray material is sprayed by ultrasonic waves, there are advantages in that droplets have uniform diameters, and excellent and silent atomization. The ultrasonic atomizer may save energy and prevent pollution, and may be used even at a location where a flow velocity is low and at a location where a supply flow rate is low. The ultrasonic atomizer may be applicable in various industrial fields such as a process of manufacturing a semiconductor, and fuel combustion, in addition to the process of manufacturing the sustained-release microspheres.

However, in a case in which an ultrasonic element of the ultrasonic atomizer is exposed to a high temperature, the high temperature may have an effect on an ultrasonic vibration generating unit, such that the ultrasonic vibration generating unit may deteriorate. Therefore, it is important to maintain a constant temperature of the ultrasonic vibration generating unit. In the related art, because of these characteristics, the ultrasonic atomizer is sterilized in a high-pressure steam sterilizer, and then mounted in a sterilized spray dryer, and then the spray drying process is carried out. However, because of the work for separately sterilizing respective apparatuses and then mounting the ultrasonic atomizer in the spray dryer, the sterilized spray dryer and the sterilized ultrasonic atomizer may be contaminated again. To solve the above problems, a method capable of protecting the ultrasonic element is required when the spray dryer is sterilized through the high-temperature dry heat sterilization method in a state in which the ultrasonic atomizer is mounted in the spray dryer.

The above information disclosed in this Background section is only for enhancement of understanding of the background of the invention and therefore it may contain information that does not form the prior art that is already known in this country to a person of ordinary skill in the art.

SUMMARY OF THE INVENTION

In the case of the ultrasonic atomizer in the related art, the ultrasonic vibrator is cooled by compressed air at room temperature in order to eliminate heat generated in the ultrasonic vibrator. However, the cooling effect of the compressed air is very insignificant in a case in which the ultrasonic atomizer is exposed to a high temperature of 250° C. or higher. In addition, in order to obtain a sufficient cooling effect by using the compressed air, a separate apparatus capable of additionally cooling the air is required. An exemplary embodiment of the present invention provides an ultrasonic atomizer which is capable of maintaining a constant temperature of an ultrasonic vibration generating unit by decreasing a temperature at the periphery of the ultrasonic vibration generating unit without constructing a separate additional apparatus even under an environment in which the ultrasonic vibration generating unit is exposed to a high temperature.

An exemplary embodiment of the present invention provides an ultrasonic atomizer including: an ultrasonic vibration generating unit which generates ultrasonic waves and atomizes a spray material; a nozzle unit which includes a spray flow path in which the spray material moves along a central axis that penetrates a center of the ultrasonic vibration generating unit, and includes a nozzle tip which is supplied with the spray material from one end of the spray flow path, and sprays the spray material from the other end of the spray flow path; a heat exchange unit which surrounds the ultrasonic vibration generating unit and cools heat generated from the ultrasonic vibration generating unit; and a housing which surrounds the ultrasonic vibration generating unit and the heat exchange unit, and has a plurality of heat exchange chambers therein, in which the a plurality of heat exchange chambers include: a vortex chamber which is positioned in the housing at the periphery of the ultrasonic vibration generating unit, and guides a vortex flow; and a thermal insulation chamber which surrounds the vortex chamber, has a separation wall which abuts the vortex chamber, and includes an internal thermal insulation space.

A height of a lower central portion of the housing may be greater than a height of a lower peripheral portion, and a lower portion of the ultrasonic vibration generating unit may be positioned on the lower central portion.

The heat exchange unit may include a cooling portion which cools the outside of the ultrasonic vibration generating unit, and a thermal insulation portion which insulates a peripheral portion of the ultrasonic vibration generating unit. The cooling portion may include a vortex flow forming unit which has one end exposed to the outside of the housing, the other end positioned in the vortex chamber in the housing, and a cooling tube which guides spray of the cooling air into the ultrasonic vibration generating unit. The vortex flow forming unit may be formed as a vortex tube. The ultrasonic atomizer may further include a cooling air discharge unit which is positioned to be inclined to an upper side of the housing from the vortex chamber, and guides the discharge of the cooling air.

The thermal insulation portion may further include a thermal insulator which is positioned in the thermal insulation chamber and maintains a constant temperature.

The ultrasonic atomizer may further include: an ultrasonic wave oscillator which is electrically connected to the ultrasonic vibration generating unit and generates an output frequency inputted through electrical energy; a spray material inlet which is positioned to be exposed to the outside of the housing at one end of the nozzle unit, and accommodates the spray material therein; an ultrasonic wave oscillator connecting unit which is electrically connected to the ultrasonic wave oscillator; and a temperature sensor connecting unit which is electrically connected to a temperature sensor that detects a temperature in the housing.

The ultrasonic vibration generating unit may include a plurality of piezoelectric elements which are electrically connected to the ultrasonic wave oscillator and convert an output frequency generated by the ultrasonic wave oscillator into ultrasonic vibrational energy; and an electrode which transmits an ultrasonic wave. The nozzle unit may have a shape that becomes narrower in a direction from an upper side to a lower side.

Advantageous Effects

It is possible to maintain a constant temperature at the periphery of the ultrasonic vibration generating unit even under an environment in which the ultrasonic vibration generating unit is exposed to a high temperature.

In addition, even though the ultrasonic atomizer is used over a long period of time, it is possible to stably spray the spray material without changes in characteristics.

DETAILED DESCRIPTION OF THE EMBODIMENTS

The technical terms used herein are merely for the purpose of describing a specific exemplary embodiment, and are not intended to limit the present invention. Singular expressions used herein include plural expressions unless they have definitely opposite meanings. The terms "comprises" and/or "comprising" used in the specification specify particular features, regions, integers, steps, operations, elements, and/or components, but do not preclude the presence or addition of other particular features, regions integers, steps, operations, elements, components, and/or groups thereof.

All terms used herein including technical or scientific terms have the same meanings as meanings which are generally understood by those skilled in the art unless they are differently defined. Terms defined in advance shall be construed such that they have meanings matching those in the context of a related art, and shall not be construed as having ideal or excessively formal meanings unless they are clearly defined in the present application.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Figure 1:
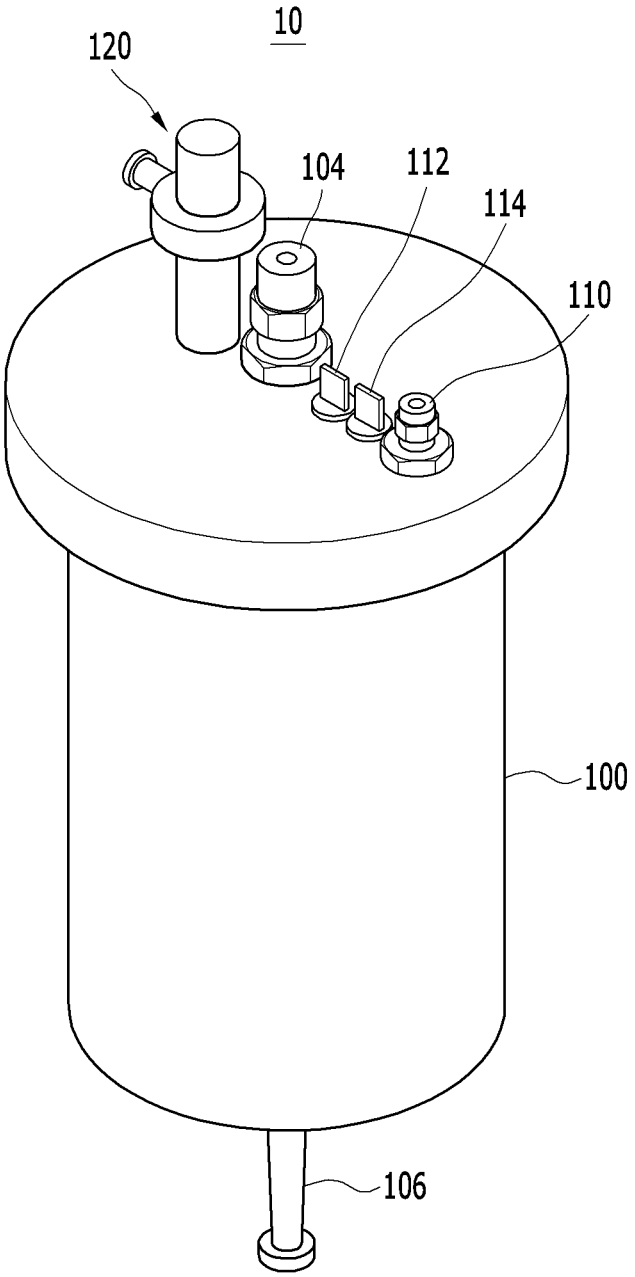
FIG. 1 is a view illustrating a perspective view of an ultrasonic atomizer according to an exemplary embodiment of the present invention.
Figure 2:
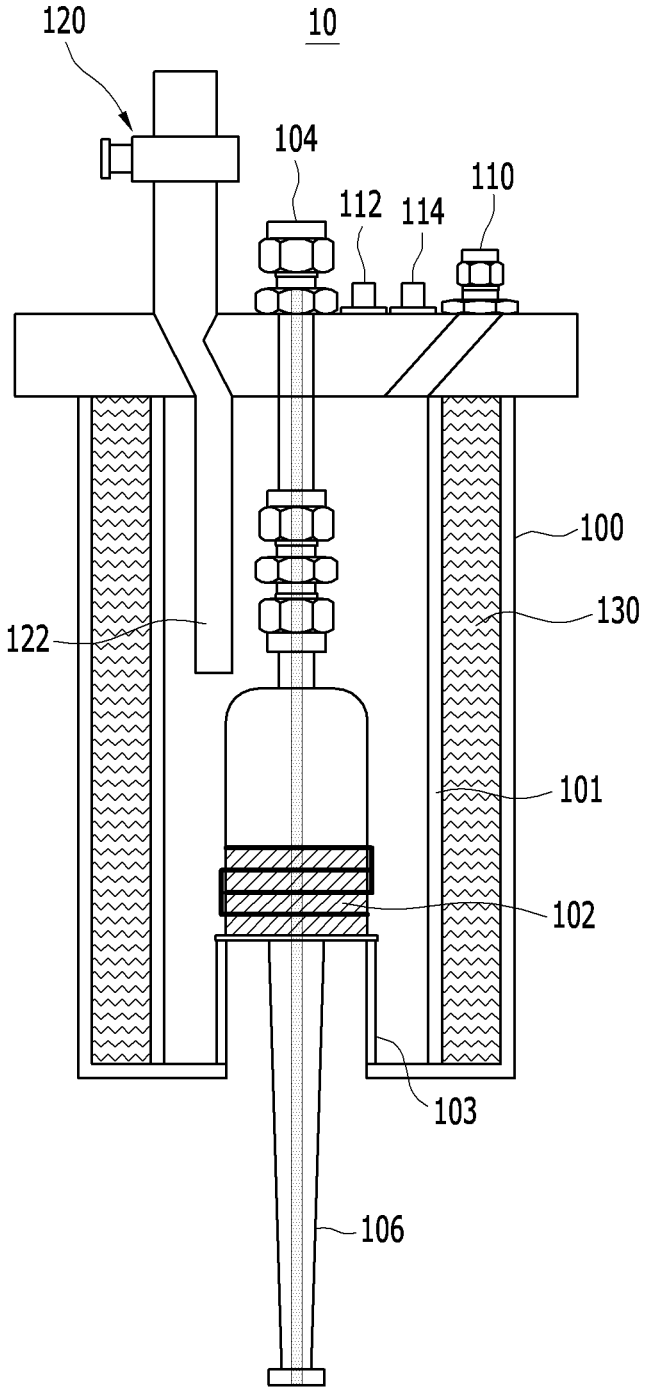
FIG. 2 is a partial cross-sectional view schematically illustrating the ultrasonic atomizer according to the exemplary embodiment of the present invention.
Figure 3:
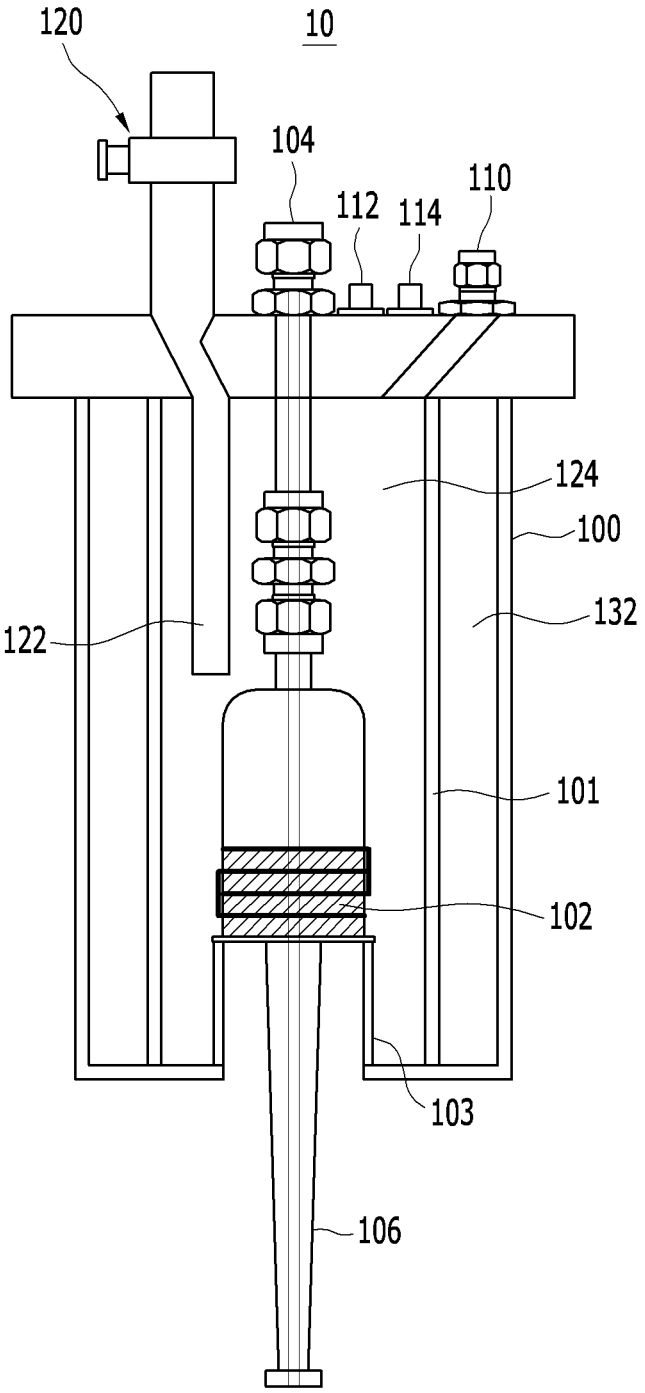
FIG. 3 is a view illustrating a state in which a thermal insulator is omitted from a thermal insulation chamber of the ultrasonic atomizer according to the exemplary embodiment of the present invention.
Figure 4:
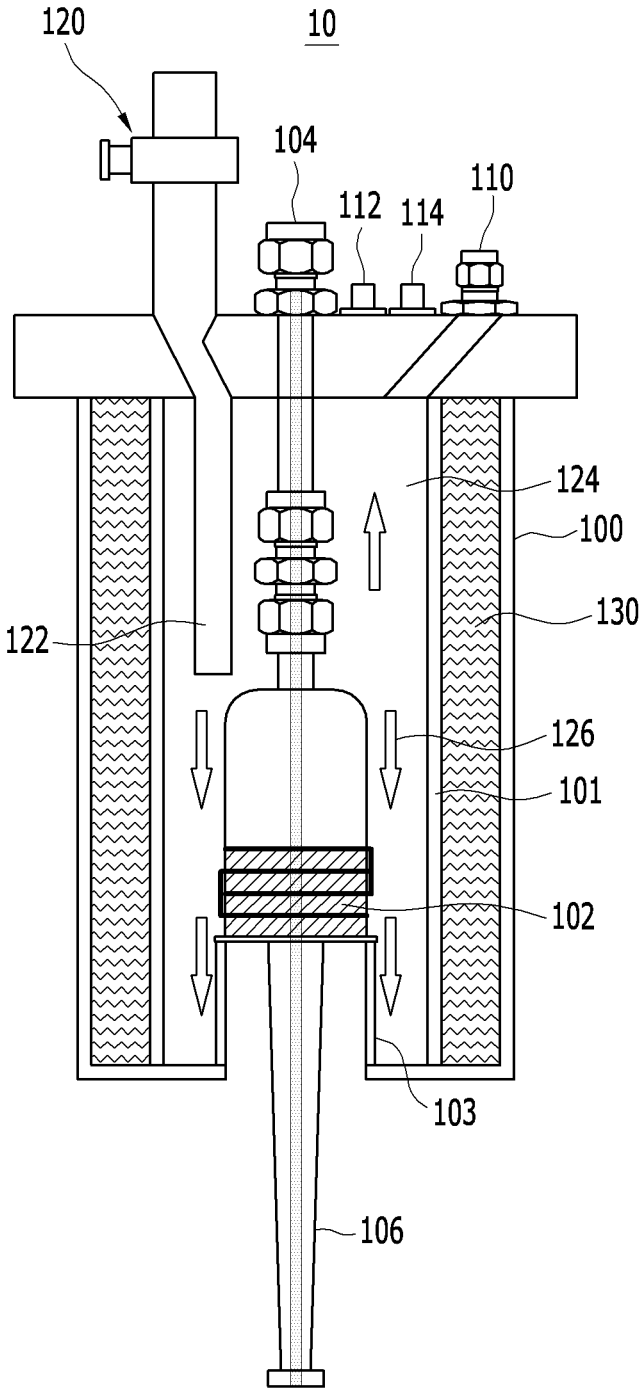
FIG. 4 is a view schematically illustrating a flow of cooling air in a vortex chamber of the ultrasonic atomizer according to the exemplary embodiment of the present invention.

FIG. 1 is a view illustrating a perspective view of an ultrasonic atomizer according to an exemplary embodiment of the present invention, and FIG. 2 is a partial cross-sectional view schematically illustrating the ultrasonic atomizer 10 according to the exemplary embodiment of the present invention, and illustrates coupling relationships among an ultrasonic vibration generating unit 102, a nozzle unit 106, a heat exchange unit, and a housing 100. FIG. 3 is a view illustrating a state in which a thermal insulator 130 is omitted from a thermal insulation chamber 132 of the ultrasonic atomizer 10, and FIG. 4 is a view schematically illustrating a flow of cooling air 126 in a vortex chamber 124 of the ultrasonic atomizer 10 according to the exemplary embodiment of the present invention.

Referring to FIGS. 1 to 4, the ultrasonic atomizer 10 according to the exemplary embodiment of the present invention includes the ultrasonic vibration generating unit 102, the nozzle unit 106, the heat exchange unit, and the housing 100. The ultrasonic atomizer 10 includes a cooling system which is capable of protecting the ultrasonic vibration generating unit 102 positioned in the ultrasonic atomizer 10 from a high temperature even if the ultrasonic vibration generating unit 102 is exposed to a high temperature of 250° C. or higher over a long period of time during a spray drying process or an aseptic process which manufactures foods and pharmaceutical drugs in the form of fine particles by spraying and drying a solution, emulsion, or suspension by using ultrasonic waves. Even if a high-temperature dry heat sterilization method is carried out by the spray dryer in a state in which an ultrasonic spray nozzle is mounted in the ultrasonic atomizer 10, it is possible to protect electronic characteristics of the ultrasonic vibration generating unit 102.

The ultrasonic vibration generating unit 102 includes an ultrasonic vibrator which generates ultrasonic waves and atomizes a spray material. The ultrasonic vibration generating unit 102 may have a cylindrical structure. The ultrasonic vibration generating unit 102 includes a plurality of piezoelectric elements which are electrically connected to an ultrasonic wave oscillator (not illustrated) and convert an output frequency generated by the ultrasonic wave oscillator into ultrasonic vibrational energy, and an electrode which transmits an ultrasonic wave. The plurality of piezoelectric elements and the electrodes may be stacked and interposed in a hollow shape.

The nozzle unit 106 includes a spray flow path in which the spray material moves along a central axis that penetrates a center of the ultrasonic vibration generating unit 102. The nozzle unit 106 includes a nozzle tip which is supplied with the spray material from one end of the spray flow path, and sprays the spray material atomized by the ultrasonic vibration generating unit 102 from the other end of the spray flow path. The nozzle unit 106 may have a shape that becomes narrower in a direction from an upper side to a lower side, and may spray the spray material by increasing amplitude and output of the spray material vibrated by the ultrasonic vibration generating unit 102.

The heat exchange unit surrounds the ultrasonic vibration generating unit 102, thereby cooling heat generated from the ultrasonic vibration generating unit 102. The heat exchange unit includes a cooling portion which cools an outer side of the ultrasonic vibration generating unit 102, and a thermal insulation portion which thermally insulates a peripheral portion of the ultrasonic vibration generating unit 102. Each of the heat exchange unit, the cooling portion, and the thermal insulation portion may have a cylindrical structure. One end of the cooling portion is exposed to the outside of the housing 100, the other end of the cooling portion is positioned in the vortex chamber 124 in the housing 100, and the heat exchange unit includes a vortex flow forming unit 120 which has a cooling tube 122 that guides the spray of the cooling air 126 to the ultrasonic vibration generating unit 102. The vortex chamber 124 may have a cylindrical structure. The vortex flow forming unit 120 may form a vortex tube. The vortex tube is used as a cooling device, the compressed air flowing into the vortex tube rotates at a high speed, and with vortex air generated at this time, cool air is discharged into the vortex chamber 124 through the cooling tube 122.

The cooling air 126, which has sprayed into the vortex chamber 124 through the vortex tube, cools the heated ultrasonic vibration generating unit 102, and then is discharged to the outside. To this end, a cooling air discharge unit 110 is further included in the housing 100. The cooling air discharge unit 110 is positioned to be inclined to an upper side of the housing 100 from the vortex chamber 124, and guides the discharge of the cooling air 126 which is sprayed from the vortex flow forming unit 120 and cools the ultrasonic vibration generating unit 102.

The thermal insulation portion may further include the thermal insulator 130 which is positioned in the thermal insulation chamber 132 and maintains a constant temperature. Each of the thermal insulation chamber 132 and the thermal insulator 130 may have a cylindrical structure. The thermal insulator 130 serves to prevent heat at the periphery of the ultrasonic vibration generating unit 102 from being transferred to the outside. The thermal insulator 130 may be implemented as a product such as asbestos, glass wool, quartz wool, diatomite, magnesium carbonate powder, magnesia powder, calcium silicate, and pearlite, including air remaining in the thermal insulation chamber 132. The thermal insulator 130 may be made of a material with low thermal conductivity, or the thermal insulator 130 may be made of a porous material to reduce thermal conductivity as necessary, and may use thermal insulation properties of air in the pores. The thermal insulator 130 may be made of an organic material or an inorganic material. If the material of the thermal insulator 130 satisfies a condition that it endures a temperature at the periphery of the ultrasonic vibration generating unit 102 like the exemplary embodiment of the present invention, a single material or mixed materials may be used as the material of the thermal insulator 130.

The housing 100 surrounds the nozzle unit 106, which is opened at a nozzle tip portion, the ultrasonic vibration generating unit 102, and the heat exchange unit, and has a plurality of heat exchange chambers 124 and 132 therein. The housing 100 may have a cylindrical structure which has an upper portion covered by a flange, a central portion of a lower portion concavely formed, and a hollow space. The plurality of heat exchange chambers 124 and 132 include the vortex chamber 124, and the thermal insulation chamber 132. The vortex chamber 124 is a vortex flow forming space which is positioned in the housing 100 at the periphery of the ultrasonic vibration generating unit 102, and guides a vortex flow. At a central portion of the housing 100, the vortex chamber 124 has a longer length than the ultrasonic vibration generating unit 102. A protective wall 103 is formed at a lower side of the vortex chamber 124 which surrounds the nozzle unit 106. The cooling air 126, which is sprayed into the vortex chamber 124, surrounds the ultrasonic vibration generating unit 102, thereby sufficiently cooling the heated ultrasonic vibration generating unit 102. At a side of the housing 100, the thermal insulation chamber 132 has a separation wall 101 which abuts the vortex chamber 124, and includes a thermal insulation space. The thermal insulation chamber 132 has a shape that surrounds the vortex chamber 124 at an outer wall inside the housing 100, and extends in a longitudinal direction of the housing 100. Since the thermal insulator 130 is interposed in the thermal insulation chamber 132, it is possible to constantly maintain the lowered temperature in the vortex chamber 124.

A height of a lower central portion of the housing 100 where the ultrasonic vibration generating unit 102 is positioned is greater than a lower peripheral portion of the housing 100, and a lower portion of the ultrasonic vibration generating unit 102 is positioned on the lower central portion and surrounded by the lower peripheral portion. That is, the lower portion of the housing 100 has a shape such that a central portion at which the ultrasonic vibration generating unit 102 is positioned is concavely formed. By minimizing the exposure of the ultrasonic vibration generating unit 102 to the outside, it is possible to reduce an effect of heat that may be transmitted from a peripheral environment to the ultrasonic vibration generating unit 102. The lower portion of the housing 100 is concavely formed so that the ultrasonic vibration generating unit 102 is positioned inside the housing 100, thereby maximizing cooling efficiency of the ultrasonic vibration generating unit 102.

Meanwhile, the ultrasonic atomizer 10 according to the exemplary embodiment of the present invention further includes an ultrasonic wave oscillator, a spray material inlet 104, an ultrasonic wave oscillator connecting unit 112, a temperature sensor connecting unit 114. The ultrasonic wave oscillator is electrically connected to the ultrasonic vibration generating unit 102 and generates an output frequency inputted through electrical energy. The spray material inlet 104 is positioned to be exposed to the outside of the housing 100 at one end of the nozzle unit 106, and accommodates the spray material therein. The ultrasonic wave oscillator connecting unit 112 is a connecting unit electrically connected to the ultrasonic wave oscillator. The temperature sensor connecting unit 114 is a connecting unit electrically connected to a temperature sensor that detects a temperature in the housing 100.

A cooling operation and a thermal insulation operation of the ultrasonic atomizer 10 according to the exemplary embodiment of the present invention will be described with reference to FIGS. 1 to 4.

When the ultrasonic vibration generating unit 102 is exposed to a high temperature of 200° C. or higher, electronic characteristics of the ultrasonic vibration generating unit 102 are lost, such that the ultrasonic vibration generating unit 102 cannot be normally operated. When the ultrasonic vibration generating unit 102 is in contact with heat of a high temperature, a frequency decreases due to an increase in temperature, and an electrostatic capacity increases, such that normal ultrasonic wave oscillation cannot occur. Therefore, a temperature at the periphery of the ultrasonic vibration generating unit 102 needs to be constantly maintained. For example, in a case in which an aseptic injection is produced during a process of manufacturing a sustained-release microsphere injection, the ultrasonic nozzle is sterilized in an autoclave, and then mounted in the spray dryer. However, because there is a risk that facilities will be contaminated because of this work, the spray dryer needs to be sterilized (dry heat sterilization) in a state in which the ultrasonic nozzle is mounted. That is, a method, which may protect the ultrasonic vibration generating unit 102 even at a high-temperature dry heat sterilization temperature of 250° C. or higher is required.

The exemplary embodiment of the present invention provides the ultrasonic atomizer 10 which may protect the ultrasonic vibration generating unit 102 even at a high-temperature dry heat sterilization temperature or higher. Referring to FIGS. 1 to 4, the cooling air 126 is sprayed into the vortex chamber 124 in a state in which the vortex tube is mounted and the thermal insulator 130 is interposed in the housing 100 provided with the vortex chamber 124 and the thermal insulation chamber 132. Further, the heated ultrasonic vibration generating unit 102 may be cooled and thermal insulation may be maintained by the function of the thermal insulator 130 interposed at the periphery of the vortex chamber 124.

First, operations of cooling the ultrasonic atomizer 10 and maintaining thermal insulation will be described on the assumption that the ultrasonic vibration generating unit 102 is heated. In a state in which the ultrasonic vibration generating unit 102 is heated, the cooling air 126 is discharged in a direction of the ultrasonic vibration generating unit 102 through the cooling tube 122 of the vortex tube provided in the vortex chamber 124 in the housing 100. The cooling air 126 discharged to the ultrasonic vibration generating unit 102 is used as a coolant for cooling the heated ultrasonic vibration generating unit 102. The cooling air 126 performs a cooling operation in accordance with an air stream formed in the vortex chamber 124, and is discharged to the outside of the housing 100 through the cooling air discharge unit 110. In this case, the thermal insulator 130 serves to constantly maintain the lowered temperature in the vortex chamber 124. Therefore, it is possible to prevent heat generated in the ultrasonic vibration generating unit 102 from being transferred to the outside of the housing 100, and a temperature of the ultrasonic vibration generating unit 102 does not increase because of a cooling operation of the cooling air 126 between the ultrasonic vibration generating unit 102 positioned in the vortex chamber 124 and the housing 100, and as a result, it is possible to improve cooling efficiency of the ultrasonic vibration generating unit 102.

As described above, in a case in which cool air at a temperature of 10° C. or lower is supplied into the vortex chamber 124 though the vortex tube by using dry air at the room temperature when a process of sterilizing the ultrasonic atomizer 10 is carried out, it is possible to protect the ultrasonic vibration generating unit 102 so that the ultrasonic vibration generating unit 102 is prevented from being exposed to a high temperature even though the outside of the housing 100 is exposed to a high temperature of 200° C. or higher. The ultrasonic atomizer 10 according to the exemplary embodiment of the present invention may be sterilized by the high-temperature dry heat sterilization, and with the combined configurations of the cooling portion and the thermal insulator 130, the ultrasonic atomizer 10 may stably spray the spray material without changes in characteristics despite use over a long period of time by maintaining a constant temperature at the periphery of the ultrasonic vibration generating unit 102 even under an environment in which the ultrasonic atomizer 10 is exposed to a high temperature.

In one or more implementations, an ultrasonic atomizer capable of maintaining a constant temperature of an ultrasonic vibration generating unit by decreasing a temperature at the periphery of the ultrasonic vibration generating unit even under an environment in which the ultrasonic vibration generating unit is exposed to a high temperature is provided. The ultrasonic atomizer includes: an ultrasonic vibration generating unit which generates ultrasonic waves and atomizes a spray material; a nozzle unit which includes a spray flow path in which the spray material moves along a central axis that penetrates a center of the ultrasonic vibration generating unit, and includes a nozzle tip which is supplied with the spray material from one end of the spray flow path, and sprays the spray material from the other end of the spray flow path; a heat exchange unit which surrounds the ultrasonic vibration generating unit and cools heat generated from the ultrasonic vibration generating unit; and a housing which surrounds the ultrasonic vibration generating unit and the heat exchange unit, and has a plurality of heat exchange chambers therein, in which the a plurality of heat exchange chambers include: a vortex chamber which is positioned in the housing at the periphery of the ultrasonic vibration generating unit and guides a vortex flow; and a thermal insulation chamber which surrounds the vortex chamber and has a separation wall which abuts the vortex chamber, and includes an internal thermal insulation space.

The exemplary embodiment of the present invention has been described with reference to the accompanying drawings, but those skilled in the art will understand that the present invention may be implemented in other specific forms without changing the technical spirit or an essential feature thereof. For example, the present invention may further include an auxiliary housing which surrounds the entirety of the housing 100 to protect the housing 100 from an external environment, and may more effectively maintain a temperature at the periphery of the ultrasonic vibration generating unit 102. Of course, the auxiliary housing also belongs to the scope of the present invention.

Thus, it should be appreciated that the exemplary embodiments described above are intended to be illustrative in every sense, and not restrictive. The scope of the present invention is represented by the claims to be described below rather than the detailed description, and it should be interpreted that all the changes or modified forms, which are derived from the meaning and the scope of the claims, and the equivalents thereto, are included in the scope of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An ultrasonic atomizer comprising:

an ultrasonic vibration generating unit which generates ultrasonic waves and atomizes a spray material;

a nozzle unit which includes a spray flow path in which the spray material moves along a central axis that penetrates a center of the ultrasonic vibration generating unit, and includes a nozzle tip which is supplied with the spray material from one end of the spray flow path, and sprays the spray material from the other end of the spray flow path;

a heat exchange unit which surrounds the ultrasonic vibration generating unit and cools heat generated from the ultrasonic vibration generating unit; and a housing which surrounds the ultrasonic vibration generating unit and the heat exchange unit, and has a plurality of heat exchange chambers therein, wherein the plurality of heat exchange chambers include:

a vortex chamber which is positioned in the housing at the periphery of the ultrasonic vibration generating unit, and guides a vortex flow; and a thermal insulation chamber which surrounds the vortex chamber, and has a separation wall which abuts the vortex chamber, and includes an internal thermal insulation space, the heat exchange unit includes a cooling portion which cools the outside of the ultrasonic vibration generating unit, and the cooling portion includes a vortex flow forming unit which has one end exposed to the outside of the housing and the other end positioned in the vortex chamber in the housing, and a cooling tube which guides and rotates spray of a cooling air into the vortex chamber of the ultrasonic vibration generating unit.

2. The ultrasonic atomizer of claim 1, wherein a height of a lower central portion of the housing is greater than a height of a lower peripheral portion, and a lower portion of the ultrasonic vibration generating unit is positioned at the lower central portion.

3. The ultrasonic atomizer of claim 1, wherein the heat exchange unit further includes a thermal insulation portion which insulates a peripheral portion of the ultrasonic vibration generating unit.

4. The ultrasonic atomizer of claim 1, wherein the vortex flow forming unit is a vortex tube.

5. The ultrasonic atomizer of claim 1, further comprising:

a cooling air discharge unit which is positioned to be inclined to an upper side of the housing from the vortex chamber, and guides discharge of the cooling air.

6. The ultrasonic atomizer of claim 3, wherein the thermal insulation portion further includes a thermal insulator which is positioned in the thermal insulation chamber and maintains a constant temperature.

7. The ultrasonic atomizer of claim 1, further comprising:

an ultrasonic wave oscillator which is electrically connected to the ultrasonic vibration generating unit and generates an output frequency inputted through electrical energy;

a spray material inlet which is positioned to be exposed to the outside of the housing at one end of the nozzle unit, and accommodates the spray material therein;

an ultrasonic wave oscillator connecting unit which is electrically connected to the ultrasonic wave oscillator; and a temperature sensor connecting unit which is electrically connected to a temperature sensor that detects a temperature in the housing.

8. The ultrasonic atomizer of claim 7, wherein the ultrasonic vibration generating unit includes a plurality of piezoelectric elements which are electrically connected to the ultrasonic wave oscillator and convert the output frequency generated by the ultrasonic wave oscillator into ultrasonic vibrational energy; and an electrode which transmits an ultrasonic wave.

9. The ultrasonic atomizer of claim 1, wherein the nozzle unit has a shape that becomes narrower in a direction from an upper side to a lower side.

* * * * *